US009053644B2

(12) United States Patent
Bier et al.

(10) Patent No.: US 9,053,644 B2
(45) Date of Patent: Jun. 9, 2015

(54) ARRANGEMENT OF IDENTIFICATION PLATES

(75) Inventors: Klaus-Dieter Bier, Leutenbach (DE); Juergen Schmid, Baltmannsweiler (DE); Andreas Hetzel, Backnang-Waldrems (DE)

(73) Assignee: Murrplastik Systemtechnik GmbH, Oppenweiler (DE)

( * ) Notice: Subject to any disclaimer, the term of this patent is extended or adjusted under 35 U.S.C. 154(b) by 0 days.

(21) Appl. No.: 14/344,077

(22) PCT Filed: Aug. 30, 2012

(86) PCT No.: PCT/EP2012/066844
§ 371 (c)(1),
(2), (4) Date: Mar. 11, 2014

(87) PCT Pub. No.: WO2013/037642

PCT Pub. Date: Mar. 21, 2013

(65) Prior Publication Data

US 2014/0338241 A1 Nov. 20, 2014

(30) Foreign Application Priority Data

Sep. 16, 2011 (DE) ..... 10 2011 113 379

(51) Int. Cl.
*G09F 3/00* (2006.01)
*G09F 3/04* (2006.01)
(Continued)

(52) U.S. Cl.
CPC ..... *G09F 3/04* (2013.01); *G09F 3/0295* (2013.01); *G09F 3/205* (2013.01); *G09F 3/0288* (2013.01); *G09F 2003/0222* (2013.01); *G09F 2003/0257* (2013.01)

(58) Field of Classification Search
CPC ..... B25H 3/04; B23B 3/266; G09F 3/0295; G09F 3/04; G09F 3/14
USPC ..... 40/316, 361, 633, 657; 428/40.1
See application file for complete search history.

(56) References Cited

U.S. PATENT DOCUMENTS 3,921,798 A * 11/1975 Dean et al. ..... 206/53
4,205,470 A * 6/1980 Kapnek ..... 40/782
(Continued)

FOREIGN PATENT DOCUMENTS

DE 43 43 635 A1 7/1994
DE 44 13 959 B4 2/2006
(Continued)

OTHER PUBLICATIONS

International Search Report of PCT/EP2012/066844, mailed Nov. 29, 2012.
(Continued)

*Primary Examiner* — Shin Kim
(74) *Attorney, Agent, or Firm* — Collard & Roe, P.C.

(57) ABSTRACT

The invention relates to an arrangement of multiple identification plates (10) for identifying objects. Each identification plate (10) has a flat material strip which has a front surface and a rear surface, which extends in a longitudinal direction between two ends, and which has at least one fixing tab (16), the tab being connected to the front surface and extending at a distance from the front surface in some sections. According to the invention, a base (40) is provided on which the identification plates (10) are removably fixed, the identification plate front surfaces and rear surfaces each lying on one plane, and the base (40) has a number of fixing openings (42), the number corresponding to the number of fixing tabs. One of the fixing tabs (16) protrudes through each of the fixing openings, and the fixing tabs (16) are removably fixed to the base (40).

12 Claims, 2 Drawing Sheets

Figures 1A, 1B, 1C:
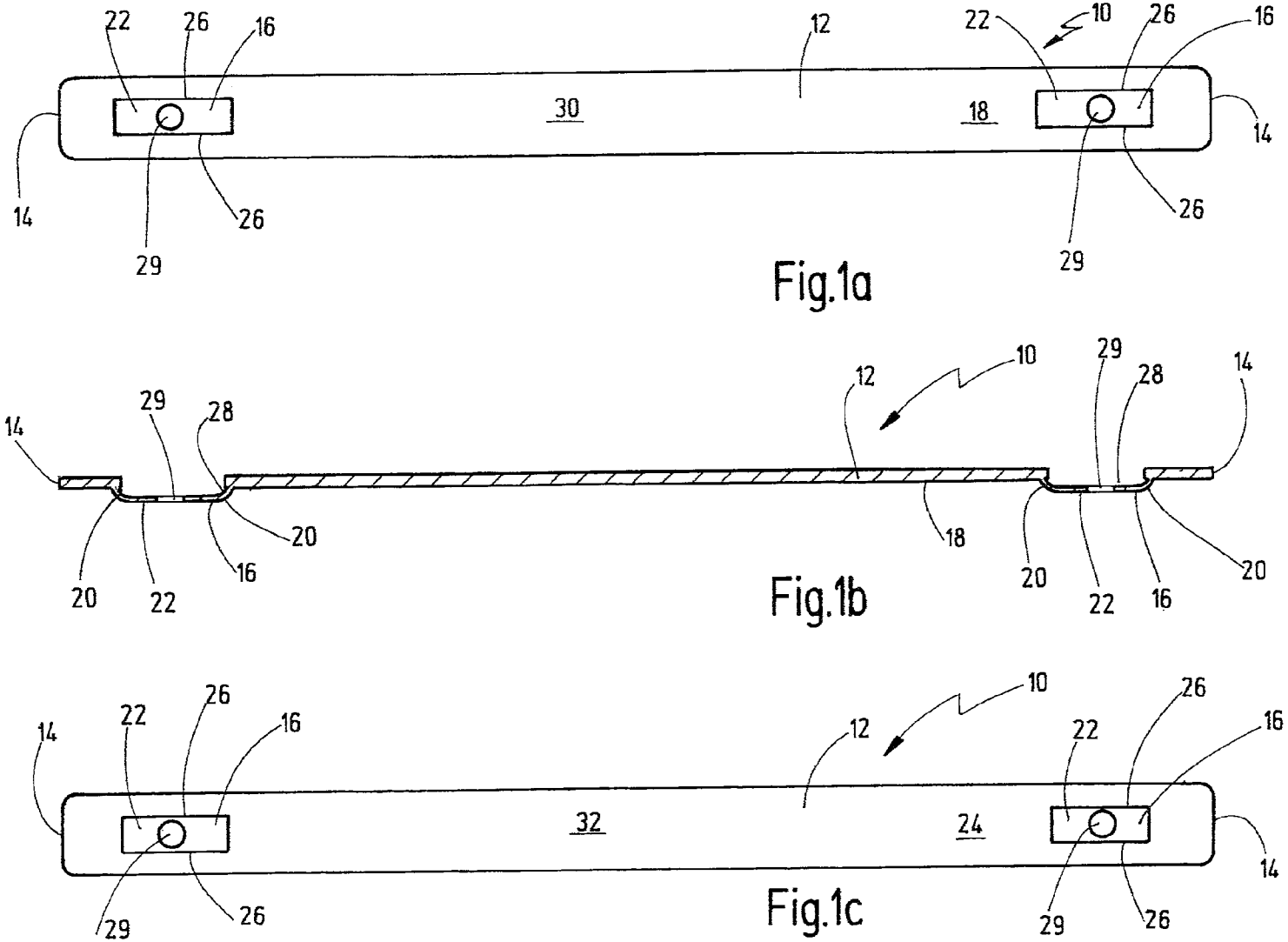

(51) Int. Cl.
*G09F 3/20* (2006.01)
*G09F 3/02* (2006.01)

(56) References Cited

U.S. PATENT DOCUMENTS

| | | | | | |
|---|---|---|---|---|---|
| 4,304,382 | A * | 12/1981 | Jelen | 248/220.42 |
| 4,441,680 | A * | 4/1984 | Rivkin et al. | 248/220.43 |
| 4,603,924 | A * | 8/1986 | Piana et al. | 312/183 |
| 4,662,094 | A * | 5/1987 | Jaffe | 40/316 |
| 4,761,086 | A * | 8/1988 | Peterpaul | 400/531 |
| 4,865,895 | A * | 9/1989 | Vlamings et al. | 428/98 |
| 4,904,335 | A * | 2/1990 | Morosini | 156/750 |
| 5,078,829 | A * | 1/1992 | Morosini | 156/751 |
| 5,163,606 | A * | 11/1992 | Isserstedt | 229/67.2 |
| 5,193,427 | A * | 3/1993 | Johannsen | 83/607 |
| 5,511,331 | A * | 4/1996 | Morosini | 40/316 |
| 5,699,901 | A * | 12/1997 | Cohen | 206/6.1 |
| 5,766,705 | A * | 6/1998 | O'Brien et al. | 428/34.9 |
| 5,855,274 | A * | 1/1999 | Piao | 206/373 |
| 5,906,350 | A * | 5/1999 | Kao | 248/688 |
| 6,076,669 | A * | 6/2000 | Ling | 206/349 |
| 6,277,456 | B1 * | 8/2001 | Bulgrin et al. | 428/40.1 |
| 6,283,311 | B1 * | 9/2001 | Lee | 211/70.6 |
| 7,073,282 | B2 * | 7/2006 | Savagian et al. | 40/316 |
| 8,316,765 | B2 * | 11/2012 | Blanks | 101/35 |
| 8,322,278 | B2 * | 12/2012 | Blanks | 101/4 |
| 8,357,442 | B2 * | 1/2013 | Whittaker et al. | 428/40.1 |
| 8,592,019 | B2 * | 11/2013 | Whittaker et al. | 428/40.1 |
| 2005/0204594 | A1 * | 9/2005 | Savagian et al. | 40/316 |
| 2008/0267686 | A1 * | 10/2008 | Blanks | 401/13 |
| 2009/0053435 | A1 * | 2/2009 | Whittaker et al. | 428/34.9 |
| 2009/0196022 | A1 * | 8/2009 | Kelly et al. | 362/126 |
| 2010/0289202 | A1 * | 11/2010 | Cordes | 269/56 |
| 2013/0177725 | A1 * | 7/2013 | Whittaker et al. | 428/40.1 |

FOREIGN PATENT DOCUMENTS

| | | | |
|---|---|---|---|
| EP | 0 545 836 | A1 | 6/1993 |
| EP | 2 287 014 | A1 | 2/2011 |
| GB | 2 277 315 | A | 10/1994 |
| GB | 2 327 411 | A | 1/1999 |

OTHER PUBLICATIONS

German Search Report dated Jul. 19, 2012 in German Patent Application No. 10 2011 113 3791 with English translation of relevant parts.

* cited by examiner

ARRANGEMENT OF IDENTIFICATION PLATES

CROSS REFERENCE TO RELATED APPLICATIONS

This application is the National Stage of PCT/EP2012/066844 filed on Aug. 30, 2012, which claims priority under 35 U.S.C. §119 of German Application No. 10 2011 113 379.1 filed on Sep. 16, 2011, the disclosures of which are incorporated by reference. The international application under PCT article 21(2) was not published in English.

The invention relates to an arrangement of multiple identification plates in accordance with the preamble of claim 1.

Such identification plates are known from GB 2 277 315 A, and serve, for example, to identify electrical components, particularly cables. An identification that characterizes the cable, in each instance, is imprinted onto the front surface or the rear surface or engraved into it. Particularly for use in an aggressive atmosphere, for example in mining, identification plates made of stainless steel are used, which are resistant to gases, acids, and other substances. Further known identification plates consist of a simple flat material strip and are attached to the cable by means of cable ties, whereby at least one cable tie is looped around the cable and the identification plate laid onto the cable. In this connection, however, it is disadvantageous that the identification plate is not fixed in place in its longitudinal direction and can slip out of the cable tie in this direction. In EP 2 287 014 A1, identification plates are shown that are laid into a cassette for storage and for transport. For inscription, the identification plates have to be taken out of the cassette and, just like the identification plates known from GB 2 277 315 A, shown only individually there, laid into an inscription device, for example a laser inscription device. Furthermore, the structure of the cassette shown in EP 2 287 014 A1 is complicated, so that the cassette is expensive in terms of production and requires a high level of material expenditure.

It is therefore the task of the invention to further develop an arrangement of identification plates of the type stated initially, in such a manner that handling is facilitated.

This task is accomplished, according to the invention, by means of an arrangement of identification plates having the characteristics of claim 1. Advantageous further developments of the invention are the object of the dependent claims.

In this connection, the at least one attachment tab fulfills two tasks. For one thing, a cable tie serving for attachment of the identification plate to the cable can be passed through under it, so that slipping of the identification plate in its longitudinal direction is made more difficult or actually prevented. For another, an attachment element of the support plate can engage on the attachment tab, so that a plurality of such identification plates can be brought together to form the identification plate arrangement. The identification plates of the arrangement can then be jointly laid into an inscription device and inscribed, whereby they are held in a predetermined position by means of the support plate. The support plate furthermore has a significantly simpler structure than the cassette described in EP 2 287 014 A1, and requires less material, which is particularly advantageous if it is supposed to be used as disposable packaging.

It is practical if the at least one attachment tab has two end sections that extend out of the front surface at a distance from one another, as well as a connection section that connects the end sections with one another, disposed at a distance from the front surface. It is practical if the connection section runs parallel to the front surface, at a distance from it. In this way, a pass-through channel for the cable tie is enclosed by the front surface and the connection section, on the one hand, as well as the end sections, on the other hand, which channel hinders the identification plate from slipping out of the cable tie in its longitudinal direction. In this connection, the end sections act as end stops for the cable tie, which prevent further slipping. It is practical if the flat material strip has two attachment tabs, which are disposed close to its ends, symmetrically with reference to a center plane that runs perpendicular to the longitudinal direction. The identification plate is then attached to the cable by means of two cable ties, which are disposed close to the ends of the flat material strip, in each instance. The surface to be inscribed is then situated between the attachment tabs; this surface can extend over part of the front surface or part of the rear surface, depending on which of the surfaces is supposed to face the cable to be identified. The connection section can furthermore be provided with a hole for passing through an attachment means, such as a screw, for example. This creates a further attachment possibility for the identification plate, while keeping the inscription surface free, so that the identification plate can also be attached to objects other than cables or similar elongated parts. If the identification plate has two attachment tabs, both connection sections can be provided with a hole, or the hole can be disposed in only one of the connection sections. The identification plates are preferably produced in one piece from sheet metal, whereby stainless steel is particularly used. In this connection, it is particularly preferred that they are stamped parts or embossed parts. The at least one attachment tab is then separated from the flat material strip on two edges that run in the longitudinal direction, and connected with the front surface in one piece, at its sides that run transverse to the longitudinal direction. Seen from the rear surface, the attachment tab forms a depression in the flat material strip.

For transport purposes, the identification plates are releasably attached to a support plate. The support plate has a number of attachment openings that corresponds to the number of attachment tabs, through which openings one of the attachment tabs, in each instance, projects. At the edge of the attachment openings, at least one attachment element that projects into the attachment opening can be disposed, in each instance, which element engages under the attachment tab, in each instance, and holds the identification plate in question in its position.

Alternatively, the attachment openings and the attachment tabs can be coordinated with one another, in terms of their size, in such a manner that a clamping effect caused by friction fit holds the identification plates in place in the support plate. The support plate thereby serves, for one thing, to accommodate the identification plates for transport and storage purposes, and replaces complicated packaging. For another thing, the support plate serves for positioning of multiple identification plates in an inscription device. For this purpose, the front surfaces and the rear surfaces of the identification plates attached to the support plate lie in a common plane, in each instance, so that the laser of a laser inscription device, for example, does not need to be focused individually for each identification plate. Preferably, the support plate has a number of inscription openings through which the front surfaces of the identification plates are visible and therefore can be inscribed. Alternatively, of course, the rear surfaces can also be inscribed, if the arrangement is laid into the inscription device with the front surfaces down.

It is possible that the attachment openings have two elastically bendable snap-in tongues that lie opposite one another, at the edge of the openings, in each instance, which tongues engage underneath the attachment tabs, the distance between which tongues, relative to one another, is less than the width of the attachment tabs, measured perpendicular to the longitudinal direction. The identification plates are then attached to the support plate simply by pressing the attachment tabs into the attachment openings, whereby the snap-in tongues are first elastically bent, and then snap back and engage under the attachment tabs.

The support plate can have one or more holes as positioning aids. In particular, a positioning mandrel of the inscription device can engage into such a hole; and position the support plate in the device, in the desired manner. Furthermore, perforation of the support plate can be provided, which makes it possible to file the entire arrangement in a folder or a ring binder. Preferably, the support plate is produced in one piece from plastic, whereby polystyrene is advantageously used. A free surface can be provided on the support plate, on which an inscription can be applied, whereby the free surface and the inscription surfaces of the identification plates can be applied during the same process step.

Figure 2:
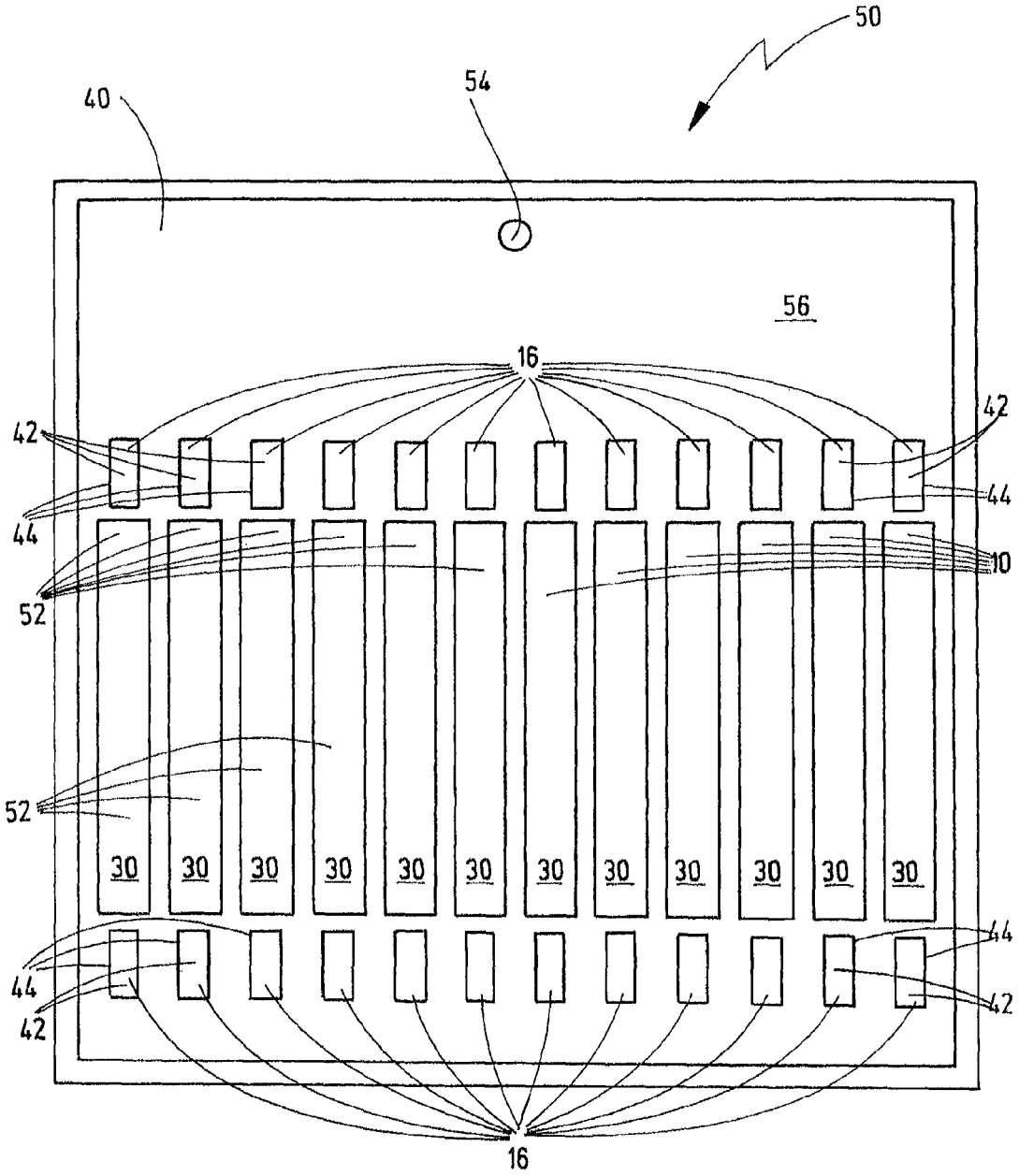

In the following, the invention will be explained in greater detail, using an exemplary embodiment shown schematically in the drawing. This shows:

FIGS. 1*a*, 1*b*, 1*c* an identification plate in a top view of the front surface, in a side view in section, and in a top view of the rear surface;

FIG. 2 an arrangement, consisting of a support plate and multiple identification plates, in a top view from the front.

The identification plate 10 shown in FIGS. 1*a, b, c* serves for identifying an electrical component such as, for example, a cable. It is produced from an essentially rectangular flat material strip 12 made of stainless steel sheet, in one piece, by means of a punching or embossing process, and extends in a longitudinal direction between two ends 14 delimited by narrow sides of the flat material strip 12. Close to the ends 14, the identification plate 10 has an attachment tab 16, in each instance, which is formed onto the flat material strip 12 in one piece. Each of the attachment tabs 16 has two end sections 20 that project out of a front surface 18 of the flat material strip 12, and a connection section 22 that connects the end sections 20 with one another, which section runs at a distance from and parallel to the front surface 18. The attachment tabs 16, which are disposed symmetrically with reference to a center plane of the identification plate 10 that runs perpendicular to the longitudinal direction, thereby form an elevation that projects out of the front surface 18 and a depression in the rear surface 24 of the flat material strip 12, which faces away from the front surface 18. The connection between the attachment tabs 16 and the front surface 18 is interrupted by means of punching, along two longitudinal edges 26, so that the end sections 20, the connection section 22, and the front surface 18 form a pass-through channel 28 (FIG. 1*b*), through which a cable tie can be passed. The connection sections 22 furthermore each have a hole 29 for passing through a screw or another attachment means, whereby the hole 29 is produced in a work cycle during punching or embossing.

The front surface 18 has a front inscription surface 30 between the attachment tabs 16, while the rear surface 24 has a rear inscription surface 32 between the attachment tabs 16. Both inscription surfaces 30, 32 can be provided with identification by means of a suitable inscription device, such as a laser inscription device, for example, which identification serves to identify a cable on which the identification plate 10 is attached. For attachment on the cable, a cable tie loops around it and is passed through the pass-through channels 28. In this connection, it is possible to attach the identification plate 10 in such a manner that the front surface 18 faces the cable, or in such a manner that the rear surface 24 faces the cable.

The arrangement 50 shown in FIG. 2 has twelve identification plates 10 according to FIGS. 1*a, b, c*, as well as a support plate 40 produced in one piece from polystyrene. The support plate 40 has twenty-four attachment openings 42 through which an attachment tab 16 is inserted, in each instance. In this connection, the attachment openings 42 are disposed in pairs, at a distance from one another, which corresponds to the distance between the attachment tabs 16 of an identification plate 10. In this connection, the attachment openings 42 are dimensioned in such a manner that they have smaller dimensions, in terms of their length and/or width, than the attachment tabs 16. However, this size difference is so slight that the attachment tabs 16 can be pressed into the attachment openings 42 with slight deformation of their edges 44, and are then held in place or clamped in place by means of friction fit. In particular, in this exemplary embodiment, the attachment tabs 16 have a slight excess dimension in terms of their width, measured perpendicular to the longitudinal direction, in comparison with the attachment openings 42, the edges 44 of which are slightly deformed when the attachment tabs 16 are pressed in, whereby this deformation takes place elastically, at least in part.

The support plate 40 serves, for one thing, for accommodating the identification plates 10, so that an identification plate set consisting of twelve identification plates 10 can be packaged, transported, and sold as a sales unit. For another thing, however, it also serves to feed the arrangement 50 to an inscription device. In order to be able to apply an identification on the front inscription surface 30, the support plate 40 has an inscription opening 52 between two attachment openings 42, in each instance, through which one of the front inscription surfaces 30 is visible, in each instance. Furthermore, the support plate 40 has a positioning hole 54 that serves as a reference during positioning of the arrangement 50 in the inscription device, and into which a mandrel can engage, in order to transport the arrangement 50 in the inscription device, in a defined position, and/or to hold it in this position. The support plate 40 furthermore has a free surface 56, on which, once again, an inscription can be applied.

In the exemplary embodiment shown in the drawing, the attachment tabs 16 are pressed into the attachment openings 42, and held in place there with friction fit. However, other embodiments are also possible, particularly with attachment elements disposed at the edges 44 of the attachment openings 42. Thus, it is possible, for example, that each attachment opening 42 has an attachment element that extends from its edge 44, on one side, inward, which element engages under the attachment tab 16, in each instance. The identification plates 10 are then simply suspended into the attachment openings 42 with their attachment tabs 16. Furthermore, it is possible that an elastically bendable snap-in tongue extends into the interior of the attachment opening 42, from the two longer sides of the edge 44 of each attachment opening 42, whereby the distance between the snap-in tongues is less than the width of the attachment tabs. When the attachment tabs 16 are pressed into the attachment openings 42, the snap-in tongues are elastically deformed and snap back, in order to engage under the attachment tab 16 from both sides.

In summary, the following should be stated: The invention relates to an arrangement of multiple identification plates 10 for identifying objects, whereby each identification plate 10 has a flat material strip 12 that has a front surface 18 and a rear surface 24 and extends in a longitudinal direction between two ends 14, which strip has at least one attachment tab 16 that is connected with the front surface 18 and extends, by sections, at a distance from the front surface 18. According to the invention, a support plate 40 is provided, on which the identification plates 10 are releasably attached, whereby their front surfaces 18 and their rear surfaces 24 lie in one plane, in each instance, whereby the support plate 40 has a number of attachment openings 42 that corresponds to the number of attachment tabs 16, through which openings one of the attachment tabs 16 projects, in each instance, and whereby the attachment tabs 16 are releasably attached to the support plate 40.

The invention claimed is:

1. Arrangement of multiple identification plates (10) for identifying objects, wherein each identification plate (10) has a flat material strip (12) that has a front surface (18) and a rear surface (24) and extends in a longitudinal direction between two ends (14), which strip has at least one attachment tab (16) that is connected with the front surface (18) and extends, by sections, at a distance from the front surface (18), comprising a support plate (40), on which the identification plates (10) are releasably attached, wherein their front surfaces (18) and their rear surfaces (24) lie in one plane, in each instance, wherein the support plate (40) has a number of attachment openings (42) that corresponds to the number of attachment tabs (16), through which openings one of the attachment tabs (16) projects, in each instance, and wherein the attachment tabs (16) are releasably attached to the support plate (40); and wherein the support plate (40) has a number of inscription openings (52) corresponding to the number of identification plates (10), through which openings the front surfaces (18) of the identification plates (10) are visible.

2. Arrangement according to claim 1, wherein the attachment tabs (16) are attached to the edges (44) of the attachment openings (42) by means of friction fit.

3. Arrangement according to claim 1, wherein the support plate (40) has at least one hole (54) serving as a positioning aid.

4. Arrangement according to claim 1, wherein the support plate (40) has a perforation for filing it in a folder or a ring binder.

5. Arrangement according to claim 1, wherein the support plate (40) is produced in one piece from plastic, preferably polystyrene.

6. Arrangement according to claim 1, wherein the support plate (40) has a free surface (56) for applying an inscription.

7. Arrangement according to claim 1, wherein the section (22) of the at least one attachment tab (16) that extends at a distance from the front surface (18) runs parallel to the front surface (18) on each of the identification plates (10).

8. Arrangement according to claim 1, wherein the flat material strip (12) of each of the identification plates (10) has two attachment tabs (16), which are disposed close to its ends (14), symmetrically with reference to a center plane that runs perpendicular to the longitudinal direction.

9. Arrangement according to claim 1, wherein each of the identification plates (10) is produced from sheet metal, particularly from stainless steel, in one piece.

10. Arrangement according to claim 9, wherein each of the identification plates (10) is configured as a stamped part or as an embossed part.

11. Arrangement according to claim 9, wherein the at least one attachment tab (16) of each of the identification plates (10) is separated from the flat material strip (12) on two edges (26) that run in the longitudinal direction.

12. Arrangement of multiple identification plates (10) for identifying objects, wherein each identification plate (10) has a flat material strip (12) that has a front surface (18) and a rear surface (24) and extends in a longitudinal direction between two ends (14), which strip has at least one attachment tab (16) that is connected with the front surface (18) and extends, by sections, at a distance from the front surface (18), comprising a support plate (40), on which the identification plates (10) are releasably attached, wherein their front surfaces (18) and their rear surfaces (24) lie in one plane, in each instance, wherein the support plate (40) has a number of attachment openings (42) that corresponds to the number of attachment tabs (16), through which openings one of the attachment tabs (16) projects, in each instance, and wherein the attachment tabs (16) are releasably attached to the support plate (40);

wherein the at least one attachment tab (16) of each identification plate (10) has two end sections (20) that extend out of the front surface (18) at a distance from one another, as well as a connection section (22) that connects the end sections (20) with one another, disposed at a distance from the front surface (18); and wherein the connection sections (22) have a hole (29), in each instance, for passing an attachment means through.

* * * * *